US005618589A

United States Patent [19]

McFarland

[11] Patent Number: 5,618,589

[45] Date of Patent: Apr. 8, 1997

[54] METHOD AND APPARATUS FOR COATING ELONGATE MEMBERS

[75] Inventor: Roger A. McFarland, Newark, Ohio

[73] Assignee: Owens Corning Fiberglas Technology, Inc., Summit, Ill.

[21] Appl. No.: 348,691

[22] Filed: Dec. 2, 1994

[51] Int. Cl.[6] ..... B05B 5/14

[52] U.S. Cl. ..... 427/482; 118/308; 118/309; 118/630; 118/634; 156/279; 264/131; 425/104; 425/106; 427/195; 427/485; 427/486; 427/534; 427/536

[58] Field of Search ..... 427/195, 482, 427/485, 486, 534, 536; 118/308, 309, 630, 634; 264/131; 425/104, 106; 156/279

[56] References Cited

U.S. PATENT DOCUMENTS

| | | | |
|---|---|---|---|
| 4,104,416 | 8/1978 | Parthasarathy et al. | 427/195 |
| 4,182,782 | 1/1980 | Scheiber | 427/195 |
| 4,244,985 | 1/1981 | Graff et al. | 427/195 |
| 4,681,722 | 7/1987 | Carter et al. | 264/171 |
| 4,729,340 | 3/1988 | Zeiss et al. | 118/634 |
| 4,883,690 | 11/1989 | Carter | 427/430.1 |
| 5,059,446 | 10/1991 | Winkle, Sr. et al. | 427/195 |
| 5,178,902 | 1/1993 | Wong et al. | 427/195 |
| 5,236,536 | 8/1993 | Brehm et al. | 156/345 |
| 5,275,659 | 1/1994 | Shutic et al. | 118/315 |
| 5,310,582 | 5/1994 | Vyakarnam et al. | 427/560 |
| 5,350,603 | 9/1994 | McFarland et al. | 427/485 |

FOREIGN PATENT DOCUMENTS

| | | | |
|---|---|---|---|
| 965652 | 4/1975 | Canada . | |
| 0160485 | 11/1985 | European Pat. Off. . | |
| 0274707 | 7/1988 | European Pat. Off. . | |
| 2162982 | 7/1973 | France . | |
| 4103959 | 8/1992 | Germany | 427/534 |
| 9204985 | 4/1992 | WIPO . | |

OTHER PUBLICATIONS

Kirk–Othmer Encyclopedia of Chemical Technology, 3rd. ed., vol. 6, John Wiley & Sons, New York (1979) pp. 417–418. (no month avail.).

Patent Abstracts of Japan, vol. 16, No. 132 (M–1229), Apr. 3, 1992.

*Primary Examiner*—Bernard Pianalto

*Attorney, Agent, or Firm*—C. Michael Gegenheimer; Patrick Pacella

[57] ABSTRACT

This method and apparatus provide for uniformly coating a hot elongate member with a powder coating. The elongate member and power carry an electrostatic charge which aids in providing the uniform powder coating. This method and apparatus electrostatically charge and heat the elongated member prior to entering a powder coating booth. In the booth, we sequentially discharge the powder coating, electrostatically charge the powder coating and then coat the elongated member with the charged powder coating. In one development, this method and apparatus uniformly powder coats window lineals directly on a pultrusion line.

14 Claims, 4 Drawing Sheets

METHOD AND APPARATUS FOR COATING ELONGATE MEMBERS

TECHNICAL FIELD

The present invention relates to a method and apparatus for applying a coating of predetermined thickness over designated surface sections of a continuously advancing elongate member having a constant cross-sectional shape.

BACKGROUND OF THE INVENTION

This invention relates to applying a coating, such as paint, of a predetermined constant thickness to all or part of an elongate member, such as an FRP pultruded lineal used to fabricate windows. In the case when the elongate member is pultruded, advantages exists in coating contemporaneously or in-line with the pultrusion process. See U.S. Pat. No. 4,581,722.

Typical systems For applying paint off-line to an advancing elongate member or lineal include spray guns and rollers. These off-line systems for applying usually are not commercially economical.

A recent off-line development shown in U.S. Pat. No. 4,883,690 discloses a lineal coating method using a guide die and a coating die which are generally collinear to receive the advancing elongate member for coating. The patent teaches that a reservoir which is associated with the coating die is to be supplied by a constant pressure feed pump, delivering the paint at a desired pressure and volume. The back pressure in the reservoir is maintained at a high level, so that the reservoir will act as a manifold. The reservoir is in direct contact with the lineal and with the coating passageway.

In still another off-line improvement, U.S. patent application Ser. No. 08/238,071, filed on May 2, 1994, discloses an improved method and apparatus for coating elongated members including the use of a pressurized manifold and a slot or other high aspect ratio conduit for communicating between the manifold and the passageway in the coating die. Since the thin slot restricts the flow of paint, the pressure of paint in the coating die passage way is maintained at low levels even when the reservoir is maintained at high pressure to ensure uniform paint delivery around the part circumference, A need exists, however, to carry these systems one step farther and paint the lineals on-line. The heat distortion temperatures of most plastic substrates, however, will not tolerate the bake or cure cycle temperatures required for powder coatings, typically 300° F. to 400° F., without the aid of some type of support or backup. Since many lineals require full coating coverage on all surfaces, an external support is not practical and if used would "rob" coating intended for the lineal. Powder coating of lineals or other long pultruded shapes typically would be coated and cured in a vertical position to prevent warpage and distortion. This type of coating facility is very expensive to purchase, maintain and staff.

DISCLOSURE OF INVENTION

I now have developed an electrostatically charged powder coating method and apparatus for coating these elongate members on line. My development paints window lineals, for example, directly on a pultrusion line. My invention combines the thermal attraction of the powder coating to hot lineals with the electrostatic attraction to the powder coating. The lineal carries an electrostatic charge and the powder is charged oppositely providing attractive forces. The thermal contribution also may help initiate flow of the powder coating. The electrostatic attraction or grounding of the FRP lineal is accomplished by utilizing a conductive surfacing mat or veil. Additional grounding may occur at a topcoat applicator die.

My solution to eliminate warpage, cost and secondary operations of "off-line" painting was to powder coat "on-line" while the pultruded lineal is under tension during high temperature bake cycles to eliminate bowing and warpage. My solution also allows painting of any length lineal desired. To insure consistent powder coating adhesion to the fiberglass reinforced plastic substrate, I used an in-line cleaning and adhesion promotion process. The cleaning equipment I used was a high voltage corona discharge unit. Corona treatment of the surface oxidizes the chemical moieties on the substrate. This increases the surface energy of the surface and improves coating adhesion to the substrate.

Most all powder coating applications are for metallic substrates which are very good thermal conductors and are typically very dense and exhibit rapid heat up rates. An FRP lineal acts as an insulator with slow heat up rates and is not very dense throughout its cross-section.

A topcoat curing die performs its normal function which produces a cured lineal which exits the die at a temperature of approximately 300° F. to 350° F. If a cleaning process were to be required, it would occur after the topcoat die. A lineal temperature of 300° F. to 350° F. would enter the powder booth where single or multiple stationary tribo-charged or corona units at 60 to 100 K.V. would apply the powder coating to the lineals. Now that a uniform coating film has been applied, the lineal passes through an oven (IR or convection). The curing temperature would range 300° F. to 400° F. to obtain cure before the lineal exits the oven. The degree of cure is also controlled by oven length and line speed. The powder coated lineal now is cooled down to approximately 100° F. (±40° F.) depending on the coating characteristics, by water spray, air nozzles or air knife blow off.

BEST MODE OF CARRYING OUT THE INVENTION

Figure 1:
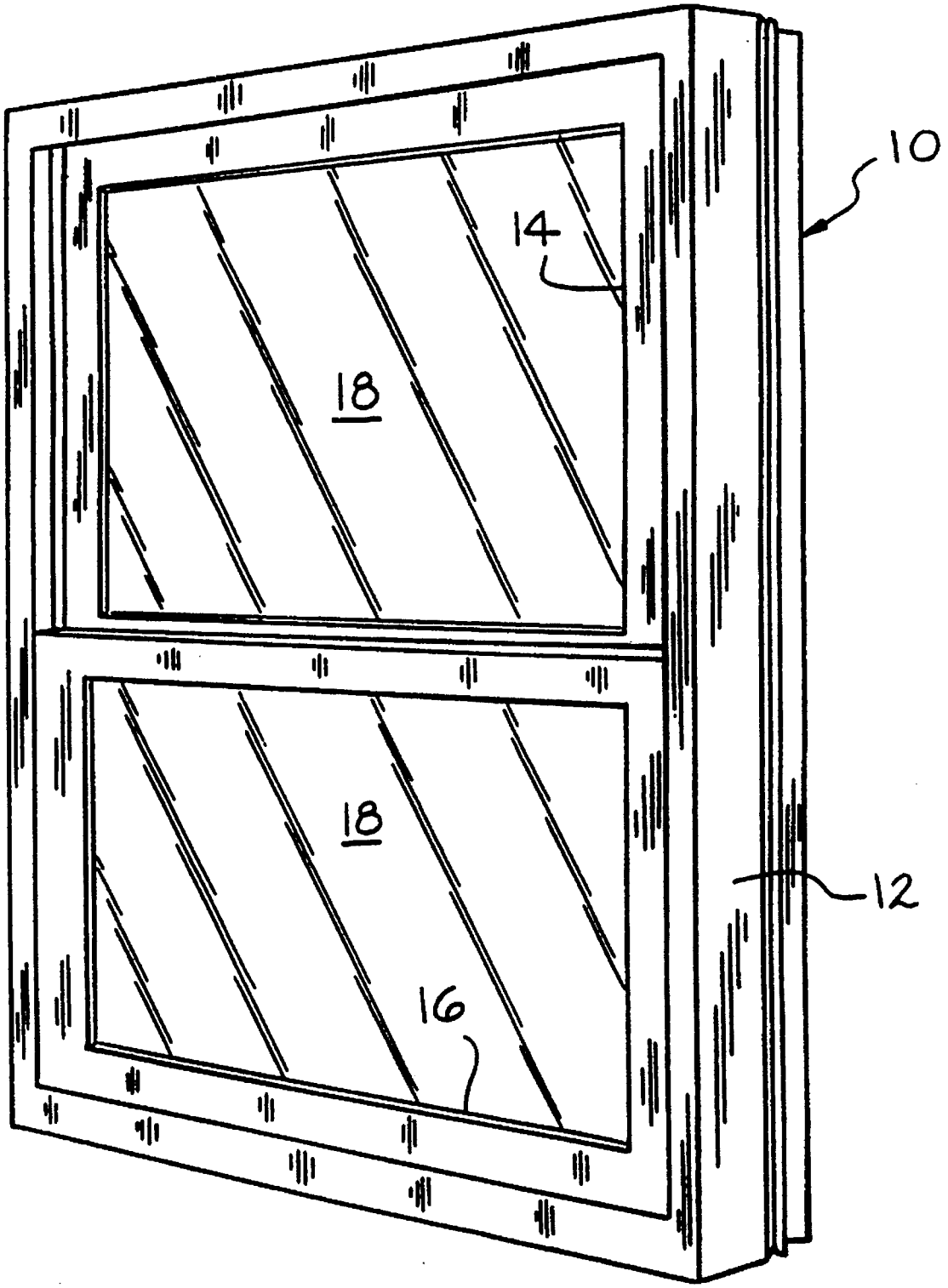
FIG. 1 is a view of a double-hung window frame and sash constructed of fibrous glass structural members.

FIG. 1 illustrates a double-hung window 10 including a frame 12 and upper and lower window sashes 14 and 16 constructed of lineal structural members. Each of frame 12 and sashes 14 and 16 has straight top, bottom and opposite side members. Each sash 14 and 16 is shown with an insulating glass unit 18 although removable double glazing may be used instead.

Figure 2:
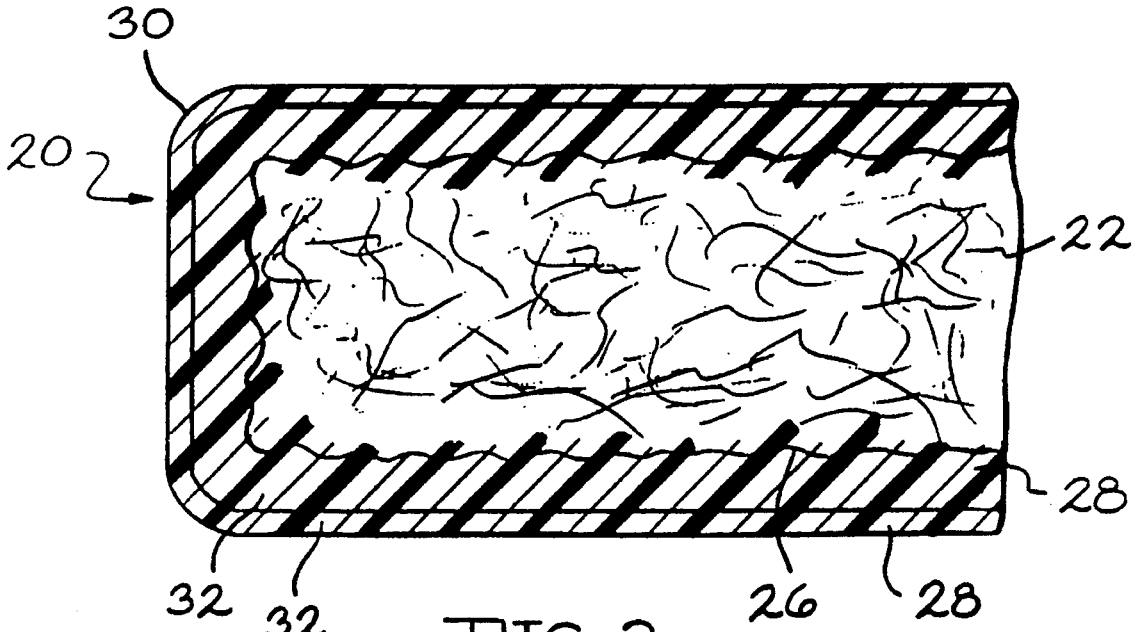
FIG. 2 is an enlarged view of a shaped fibrous glass structural member.

FIG. 2 shows shaped fibrous glass structural member 20. Core 22 for a structural member 20 is a glass fiber board including glass wool impregnated with about 20% or less, suitably 14% by weight of a phenolic resin binder such as phenol-urea-formaldehyde and molded and cured to a density of less than 20 pounds per cubic foot, suitably 6 to 8 pounds per cubic foot, and to an appropriate thickness. The board is appropriately grooved at opposite ends and slip into core 22 of appropriate rectangular cross-section. A casing encases core 22 and comprises mats 26 and 28 and rovings 30 impregnated with resin 32. The casing provides a cover around core 22 having a high quality, void-free surface finish that is reinforced. Generally, mat 26 is a polyester veil, mat 28 is a continuous glass strand mat and resin 32 is a polyester resin. Mat 26 is a conductive veil capable of being grounded.

Structural member 20 may be made by any continuous process such as by pultrusion. A preferred method and apparatus for producing the continuous elongate member is disclosed in U.S. Pat. No. 4,681,722. The coating apparatus of this invention, for example, would be incorporated into the apparatus of FIG. 1 of U.S. Pat. No. 4,681,722. Preferably, the coating apparatus of this invention would be after resin curing die 38 and cooling device 40 of FIG. 1 of U.S. Pat. No. 4,681,722.

Figure 3:
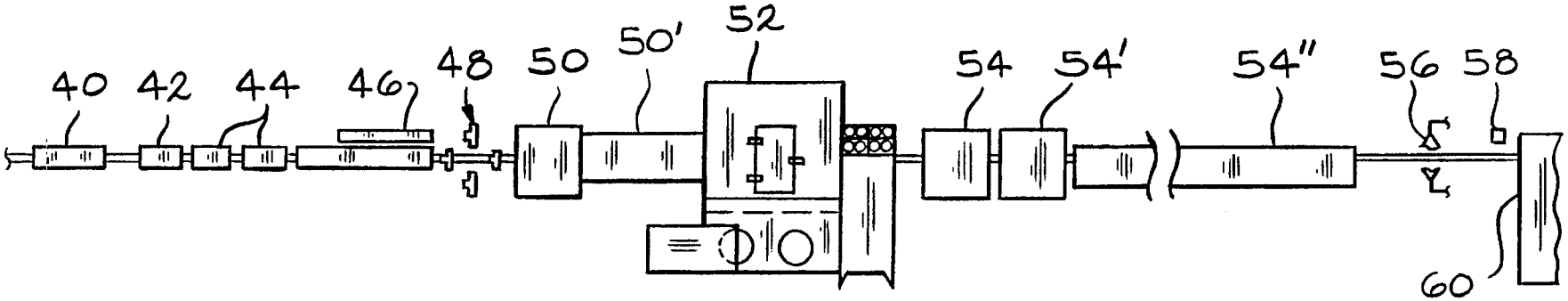
FIG. 3 is a schematic block diagram of the coating apparatus of this invention.

With respect to FIG. 3, the wool core passes over table 40 and onto primer die 42 which applies a resin to the wool core. The core then passes over inspection table 44 and through coater die 46 for application of topcoat resin. Corona heads 48 then increase the surface energy of the lineal. Ovens 50 and 50' then heat the lineal to optimum coating temperature. Ovens 50 and 50' can be an IR oven or a combustion type heater using forced hot air or heating coils. Powder coating booth 52 applies a powder coating to the lineal. Ovens 54 and 54' cure the powder coating. Ovens 54, 54' and 54" use any of the previously described means for heating. Cooling is accomplished by air or water spray onto the lineal at station 56.

Figure 4:
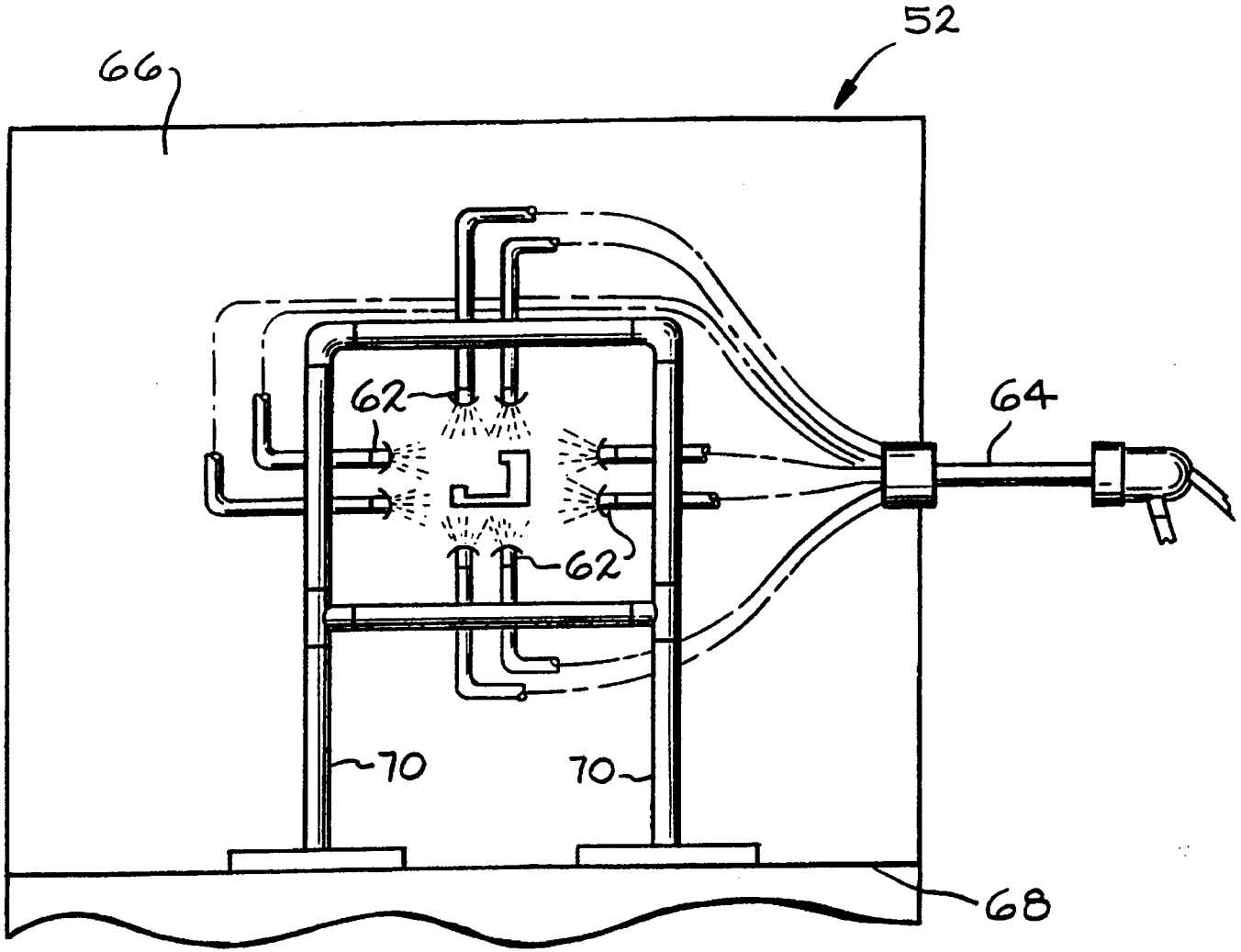
FIG. 4 is a view showing the powder booth of this invention in more detail.

FIG. 4 shows powder coating booth 52 in more detail. Powder nozzles 62 provide a uniform powder to booth 52. Air is directed downwardly from ceiling 66 toward floor 68 of booth 52. Plenum 72 supplies the downwardly directed air. Gun 64 provides an electrostatic charge to the powder coating. The charged powder coating then is attracted to the lineal because of a grounded veil mat 26. The powder coating uniformly collects on the general surface of the lineal passing through booth 52. Any oversprayed powder coating that does not adhere to the lineal is drawn through gratings (not shown) in floor 68 of booth 52. Powder collection and recovery system (not shown) located beneath floor 68 collects the oversprayed powder.

The following describes my apparatus and process in more detail. Infrared (IR) oven 50 raises the temperature of the lineal to 400° F. to 425° F. which out gasses any volatiles that may be trapped, above the cure temperature of the powder coating. Convection oven 50' maintains the lineal temperature at 350° F. (±10° F.) to insure that the lineal temperature will be at 320° F. (±10° F.) at the point of powder application to the lineal in booth 52.

Typical powder application is done with a single tribo-charged fixed position gun 64 (on smaller sash lineals) utilizing a "spray ring" concept with eight (8) fixed nozzles 62 at approximately three (3) inch distance from the lineal. The nozzles are held in position by P.V.C. tubing 70. Lineal profiles with increased surface area would require additional spray nozzles per single gun or less spray nozzles on multiple guns, or a combination of both.

Virtually all powder coating contacting the lineal surface is adhered to the hot surface (310° F. to 330° F.) and remains in a molten state which eliminates any coating loss due to vibration and the like.

Due to ambient temperatures and spray booth air flow, the lineal temperature entering IR oven 54 will drop to approximately 250° F. to 260° F. The particular powder coating used contains a heat blocked additive which initiates the coating cure and is activated at approximately 340° F. and allows the coating to cure at temperatures of 350° F. and above.

The two IR ovens 54 and 54' provide several functions. They allow for a rapid controlled heat up rate which thermally causes the coating to flow out and level at temperatures below 340° F. to 350° F. without gel or coating cure beginning.

IR ovens 54 and 54' also rise the lineal temperature, rapidly to position the coating at the initiation temperature to begin cure so that convection oven 54" only has to "maintain" a lineal temperature of 350° F. and above which permits the use of the shortest possible oven length.

The typical surface temperature of the lineal while in convection oven 54" is 365° F. (±15° F.). At these temperatures, complete coating cure is obtained at line speeds of five to seven (5 to 7) feet per minute.

The lineal temperature at the exit end of oven 54" is typically approximately 350° F., although fully cured, the coating could be marred due to temperature and abrasion.

Cooling water at a temperature of 50° F. to 80° F. is mist sprayed on the lineal to initiate cooling at station 56. Cooling of the lineal continues due to ambient air and the water wetted surface.

Final cooling and water dry off is obtained as the lineal passes through air knife 58 which completely surrounds the lineal. Air knife 58 uses compressed air at approximately 20 to 40 psi. The lineal temperature exiting air knife 58 is typically 120° F. (±20° F.) which will not be marred by puller 60 or clamping at a cutoff saw.

Additional benefits of air knife 58 is that the lineal is completely dried, otherwise the water could "gum up" the cutoff saw cause packing materials to become soaked and damaged and eliminate possibility of mildew formation, and water spotting of the coating surface.

Thus, the present invention provides a simple system for applying a powder coating at a predetermined thickness or thicknesses over a predetermined section or sections of a hot, constant cross-section elongated member. Because of the grounding of the elongate member and the electrostatic charge on the powder coating, substantially all the coating is applied to the member or collected by the overflow means. The electrostatic charges also provide a uniform thickness of powder coating to the member. The invention provides for in-line coating of a hot lineal where warpage is prevented by keeping the lineal under tension with a puller from a pultrusion process.

I claim:

1. Apparatus for applying and distributing a powder coating having a cure temperature to an advancing elongate member having a constant cross-sectional shape comprising:

a booth having an interior which provides a controlled area for applying a powder coating to an elongate member advancing through the booth;

means for enhancing adhesion of the powder coating to the elongate member prior to the elongate member entering the booth;

means for heating the advancing elongate member to a temperature above the cure temperature of the powder coating prior to the elongate member entering the booth;

means for providing a powder coating onto the elongate member mounted in the interior of the booth;

means for providing a flow of air through the interior of the booth wherein the flow of air comes in contact with the powder coating and directs the powder coating into contact with the elongate member;

means for providing an electrostatic charge to the powder coating in the booth prior to contact with the elongate member; and means for keeping the advancing elongate member under tension wherein the means for providing powder coating is located above the elongated member, the means for providing a flow of air is located above the means for providing a powder coating, and the means for providing a flow of air directs the air in a downwardly direction, and wherein the means of enhancing adhesion the elongate member is corona discharge unit.

2. An apparatus according to claim 1 wherein the means for providing a powder coating is a powder spray nozzle and the means for providing a flow of air is a plenum.

3. An apparatus according to claim 1 including a means for keeping the elongate member at a temperature above the cure temperature of the powder coating after the elongate member leaves the booth.

4. An apparatus according to claim 1 wherein the means for keeping the elongate member under tension is a puller.

5. An apparatus according to claim 1 wherein the means for heating is an infrared oven or air, convection oven.

6. A method for applying a powder coating having a cure temperature to an advancing elongate member having a constant cross-sectional shape comprising the steps of:

providing a booth having an interior which provides a controlled area for applying a powder coating to the elongate member advancing through the booth;

applying an electrostatic charge to the elongate member prior to the elongate member enter the booth;

heating the elongate member to a temperature above the cure temperature of the powder coating prior to the elongate member entering the booth;

discharging a powder coating into the interior of the booth and onto the elongate member;

electrostatically charging the powder coating in the booth prior to contact with the elongate member; and keeping the advancing elongate member under tension.

7. A process according to claim 6 wherein the elongate member is kept at a temperature above the cure temperature of the powder coating after leaving the booth.

8. A process according to claim 6 wherein a pulling means keeps the elongate member under tension.

9. A process according to claim 6 wherein an corona charger cleans the elongate member prior to the member entering the booth.

10. A process according to claim 9 wherein in the discharging step the powder coating is sprayed into the interior of the booth and in the flowing step air is blown into the interior of the booth.

11. A process according to claim 8 wherein air flows through the interior of the booth and the flow of air is in a downwardly direction.

12. A process according to claim 8 wherein the elongate member includes a conductive veil mat which carries the electrostatic charge on the elongate member.

13. A process according to claim 6 wherein in the heating step an infrared oven or a air, convection oven heats the elongate member.

14. A process according to claim 6 wherein in the heating step the elongate member is heated to a temperature ranging from 300° F. to 400° F.

* * * * *

UNITED STATES PATENT AND TRADEMARK OFFICE

CERTIFICATE OF CORRECTION

PATENT NO. : 5,618,589

DATED : April 8, 1997

INVENTOR(S) :

Roger A. McFarland

It is certified that error appears in the above-identified patent and that said Letters Patent is hereby corrected as shown below:

On the title page, Item [54] and col.1 line 1, --Powder-- should be insert after " For".

Title: Line 2, –Such As Window Lineals—should be inserted after "Members".

Claim 9, line 2, delete "cleans" and insert therefor –applies the electrostatic charge to--.

Signed and Sealed this

Thirtieth Day of December, 1997

Bruce Lehman

*Attest:*

BRUCE LEHMAN

*Attesting Officer*

*Commissioner of Patents and Trademarks*